US006283805B1

(12) United States Patent
Ishigaki

(10) Patent No.: US 6,283,805 B1
(45) Date of Patent: Sep. 4, 2001

(54) WATER JET PROPULSION TYPE OUTBOARD MOTOR

(75) Inventor: Eiichi Ishigaki, Kagawa-ken (JP)

(73) Assignee: Ishiqaki Company Limited, Tokyo (JP)

( * ) Notice: Subject to any disclaimer, the term of this patent is extended or adjusted under 35 U.S.C. 154(b) by 0 days.

(21) Appl. No.: 09/463,736

(22) PCT Filed: Oct. 1, 1998

(86) PCT No.: PCT/JP98/04434

§ 371 Date: Jan. 28, 2000

§ 102(e) Date: Jan. 28, 2000

(87) PCT Pub. No.: WO99/61312

PCT Pub. Date: Dec. 2, 1999

(30) Foreign Application Priority Data

May 28, 1998 (JP) ..... 10-146445
Jul. 1, 1998 (JP) ..... 10-185504
Jul. 1, 1998 (JP) ..... 10-185505

(51) Int. Cl.[7] ..... B63H 11/01
(52) U.S. Cl. ..... 440/46; 440/38
(58) Field of Search ..... 440/38, 46, 47, 440/49, 53, 58, 59; 114/221 A, 221 R; 416/223 R

(56) References Cited

U.S. PATENT DOCUMENTS 2,928,631 * 3/1960 Hartman ..... 248/641
3,082,732 * 3/1963 Stallman ..... 440/39

(List continued on next page.)

FOREIGN PATENT DOCUMENTS 1-237291 * 9/1989 (JP) ..... 440/39
52-141994 * 9/1989 (JP) ..... 440/39
565795 8/1993 (JP) .
07089489 4/1995 (JP) .
09309492 12/1997 (JP) .

OTHER PUBLICATIONS

Patent Abstract of Japanese Patent 07089489.
Patent Abstract of Japanese Patent 09309492

(List continued on next page.)

*Primary Examiner*—S. Joseph Morano
*Assistant Examiner*—Ajay Vasudeva
(74) *Attorney, Agent, or Firm*—Howard & Howard

(57) ABSTRACT

A water jet propelling type outboard motor (1) is provided with a casing member (50), a frame (10), a motor (11), a gear case (13), a vertical driving shaft (12), a horizontal following shaft (14), a power transmission mechanism (15), and an impeller (5). The casing member (51) has a front end water suction inlet (3*a*), a rear end jetting outlet (6*a*), a first inside space (51) extending from the suction inlet (3*a*) obliquely upward and rearward, and a second inside space (52) extending generally horizontally from a rear end of the first inside space (51) up tot he jetting outlet (6*a*). The frame (10) extends upwardly from the casing member (50) to be mounted on a ship body (2). The motor (11) is mounted on the frame (10). The gear case (13) is disposed laterally forward of the second inside space (52) and generally vertically above the water suction inlet (3*a*). The vertical driving shaft (12) extends from the motor (11) downward to be inserted into the gear case (13). The horizontal following shaft (14) extends laterally and forwardly from the second inside space (52) to be inserted into the gear case (13). The power transmission mechanism (15) is provided inside the gear case (13), and the vertical driving shaft (12) and the horizontal following shaft (14) are coupled to each other. The impeller (5) is disposed inside the second inside space (52), and it is rotated by the horizontal following shaft (14) to draw water from the water suction inlet (3*a*) and pressurize the same, thereby injecting the water from the jetting outlet (6*a*).

2 Claims, 7 Drawing Sheets

U.S. PATENT DOCUMENTS

| | | | | |
|---|---|---|---|---|
| 3,207,116 | * | 9/1965 | France | 440/41 |
| 3,249,083 | * | 5/1966 | Irgens | 440/47 |
| 3,253,567 | * | 5/1966 | Patton, Jr. | 440/46 |
| 3,279,414 | * | 10/1966 | Rabald | 440/46 |
| 3,343,368 | * | 9/1967 | Castoldi | 60/221 |
| 3,807,344 | * | 4/1974 | Giacosa | 440/39 |
| 4,055,140 | * | 10/1977 | Kirchhan | 440/46 |
| 4,281,996 | * | 8/1981 | Mouraret | 440/89 |
| 4,437,841 | * | 3/1984 | Stallman | 440/42 |
| 4,459,117 | * | 7/1984 | Jordan | 440/38 |
| 4,850,909 | * | 7/1989 | Hampton | 440/46 |
| 5,035,662 | * | 7/1991 | Royset | 440/50 |
| 5,752,863 | * | 5/1998 | Baker et al. | 440/38 |
| 5,791,954 | * | 8/1998 | Johnson, Jr. | 440/112 |
| 5,964,627 | * | 10/1999 | Detweiler | 440/58 |
| 5,989,083 | * | 11/1999 | Ishigaki et al. | 440/46 |
| 6,083,063 | * | 7/2000 | Neisen | 440/46 |

OTHER PUBLICATIONS

Japanese PCT Application JISGK–14–PCT dated Jan. 10, 1998.

Japanese PCT Application WO99/61312 dated Feb. 12, 1999.

* cited by examiner

WATER JET PROPULSION TYPE OUTBOARD MOTOR

TECHNICAL FIELD

The present invention relates to an improvement in a water jet propelling type outboard motor.

BACKGROUND ART

In Japanese Patent Application Laid-Open No. 9-309492, one example of a water jet propelling type outboard motor is disclosed which pressurizes water which has been drawn from the water by an impeller to jet the same on water surface, thereby obtaining the propelling force.

In a conventional water jet propelling type outboard motor, however, since the entire length of an outboard motor is longer, the center of gravity of a ship is shifted toward the stern of the ship so that the ship is easily put in a state where its bow has been raised. Therefore, the drawback is that straight advancing performance is lowered and meandering occurs easily so that a travelling stability may deteriorate during high speed travelling.

In the outboard motor which has been disclosed in Japanese Patent Application Laid-Open No. 9-309492, water flow rising at the stern of a ship flows in a space formed between a transom board and the outboard motor so that travelling resistance occurs. Also, water flow strikes a lower portion side face of the outboard motor to generate resistance. These resistances negatively impact steering performance.

Japanese Utility Model Application Laid-Open No. 5-65795, discloses an example of a water jet propelling motor provided with forward and rearward moveable screens before and ahead a water suction inlet. The screens prevent floating material such as dust from flowing in the motor through the water suction inlet. By opening the screens, the floating material is captured when the screens are removed due to water flow.

However, a drawback is that when it takes a long time to close the screens, floating material may flow in through the water suction inlet. Also, the inside of the opened rearward screen is subjected to water flow during travelling, and is subjected to contact with floating material. When the rearward screen is closed the floating material attached to the inside of the screen flows in through the water suction inlet. Also, when forward screen moving is closed the floating material becomes trapped between the forward screen and the rearward screen. Accordingly, it is necessary to remove the trapped floating material which is stuck to the screens when the ship stops.

DISCLOSURE OF THE INVENTION

The present invention has been attained in view of the drawbacks in the above-mentioned conventional arts, and an object thereof is to provide a compact water jet propelling type outboard motor having excellent straight advancing performance. Also, another object of the present invention is to provide a water jet propelling type outboard motor where floating material which has attached to the screens can be removed even while a ship is travelling.

In order to attain the objects, a water jet propelling type outboard motor according to a first aspect of the present invention comprises: a casing housing having a front end lower opening, a rear end transverse opening, a first inside space extending from the lower opening obliquely and rearward, and a second inside space extending generally horizontally up to the transverse opening from a rear end of the first inside space; a frame extending upwardly to be mounted to a ship body, a motor mounted on the frame; a gear case disposed transversely ahead of the second inside space and generally vertically above the lower opening; a driving vertical shaft extending downwardly from a motor to be inserted in the gearbox; a following transverse shaft extending transversely and forwardly from the second inside space to be inserted in the gear case; a power transmission mechanism disposed in the gearbox and coupling the driving vertical shaft and the following transverse shaft; and an impeller rotated by the following transverse shaft drawing and pressurizing water from the lower opening to jet the same from the transverse opening.

In the above configuration, the driving vertical shaft extending from the motor and the following transverse shaft for rotating the impeller are coupled to each other by the power transmission mechanism in the gear case, and the gear case is disposed transversely forward of the second inside space and generally vertically above the lower opening. Accordingly, the following transverse shaft can be shortened, and a projecting amount of the outboard motor extending from a ship body rearward can be reduced.

Accordingly, it is hard for the ship to be put in a state where its center of gravity has been shifted to its stern and its bow has been raised, which results in improvement in straight advancing performance during travelling and a travelling stability during a high speed sliding.

The power transmission mechanism can be constituted with an upper bearing rotatably supporting the driving vertical shaft fixed to the gear case, an upper bevel gear fixed to a lower end of the driving vertical shaft, transverse bearing rotatably supporting a front end of the transverse fixed to the gear case, and a transverse bevel gear meshing with the upper bevel gear fixed to the transverse following shaft.

According to the above configuration, as the front end of the transverse following shaft is supported by the transverse bearing, supporting strength of the transverse following shaft is increased so that wobbling is hard to occur in the transverse following shaft.

A second aspect of the present invention is an outboard motor according to the first aspect, further comprising a screen rotatably supported to a front edge of the lower opening and which moves between a closed position where the screen covers the lower opening and an open position where the screen has been shifted downwardly from the lower opening, a biasing member for biasing the screen towards the closed position, an operating shaft which is supported to the casing member rotatably in forward and rearward directions, a first engaging portion which moves together with the screen, and a second engaging portion which moves together with the operating shaft, wherein, when the operating shaft moves from a first position positioned forward to a second position positioned rearward, the first engaging portion is brought into engagement with the second engaging portion to move the screen from the closed position to the open position, and when the operation moves beyond the second position, the first engaging portion is released from the second engaging portion so that the screen is returned back to the closed position from the open position by the basing member.

The first and second engaging portions can be disposed such that a moving region of the second engaging portion obtained when the operating shaft moves from the first position to the second position overlaps a moving region of the first engaging portion obtained when the screen moves from the closed position to the open position.

When the ship travels where there is much floating material such as dust, a probability is increased that floating material will stick to the screen. For this reason, the operating shaft is appropriately moved in an inclination manner from the first position in a travelling rearward direction. Thereby, the second engaging portion is engaged with the first engaging portion, and the screen is moved so as to be opened from the closed position against a biasing force of the biasing member so that the lower opening is opened. At this time, the screen is opened from its rear. When the operating shaft moves beyond the second position, the first engaging portion is released from engagement with the second engaging portion and the screen instantaneously moves to the closed position by a biasing force of the biasing member. After the operating shaft is moved in a travelling forward direction to be returned back to the first position, when the operating shaft is again moved rearward, the screen opens the lower opening. Thus, the screen behaves such that, after it opens the lower opening slowly, it rapidly moves to the closed position.

Accordingly, while the screen is slowly moving so as to open, the floating material stuck to the screen flows due to water flow and the screen is cleaned. Also, as the screen rapidly returns from the open position to the closed position, floating material become difficult to flow in the lower opening during closing movement of the screen. Also, an effect of shaking off the floating materials which was stuck to the screen is increased due to the behavior of the screen rapidly returning to the closed position from the open position, so that cleaning of the screen is performed excellently. Furthermore, the clearing effect of the screen is further enhanced by repeatedly opening and closing. Incidentally, small floating material which has passes through the screen pass through the wide impeller to be exhausted together with pressurized water.

A structure may be achieved utilizing a cable connected to the operating shaft. The cable extends up to a steering seat and the operating shaft is operable from the steering seat via the cable.

Thereby, opening and closing operations of the screen can easily be effected from the steering seat.

A third aspect of the present invention is an outboard motor according to the first or second aspect, wherein the impeller comprises a spiral blade having an outer peripheral edge portion close to a peripheral face of the second inside space and an outer distal end portion extending towards the first inside space.

According to the above configuration, as the spiral blade has the outer peripheral distal portion extending towards the first inside space, a suction portion of the impeller can be formed widely. Therefore, the floating material which passed through the screen will not adhere to the impeller and is easily exhausted together with pressurized water from the transverse opening.

A fourth aspect of the present invention is an outboard motor according to the first or second aspect, further comprising a front contacting wall which comes in contact with a lower end portion of a transom board of the ship body in a state where the frame has been mounted on the ship body, and a continuous face is formed between a lower end of the front contacting wall and a forward peripheral edge of the lower opening.

A closely contacting plate contacting with the transom board may be attached to an outer face of the front contacting wall.

According to the above configuration, as water flow rising at the stern during travelling is prevented from flowing in between the transom board of the ship body and the outboard motor, an extra travelling resistance can be prevented from occurring. Also, the water flow rising become shard to strike on a peripheral portion for the outboard motor so that occurrence of an eddy due to such striking is prevented. Accordingly, no turbulent flow occurs below the bottom of the ship, straight advancing performance during travelling is improved, and steering operation of the ship can easily be carried out. Furthermore, as water flow at the bottom of the ship flows smoothly below the lower opening, water suction efficiency to the lower opening is improved.

Also, the lower opening may be positioned on almost the same plane as a rear bottom face of the ship body in a state where the frame has been mounted on the ship body.

Thereby, as water flow at the bottom of the ship flows more smoothly below the lower opening, straight advancing performance and water suction efficiency to the lower opening are further improved.

A fifth aspect of the present invention is an outboard motor according to the first or second aspect, wherein a rectifying plate having a flange shape is provided at a peripheral edge of the lower opening and the rectifying plate suppresses water flow coming from the rear bottom face of the ship from moving upwardly.

According to the above configuration, water flow during travel is made hard to strike on a lower side face of the outboard motor by the rectifying plate, and water flow below the lower opening is further rectified. Accordingly, straight advancing performance and water suction efficiency to the lower opening are further improved. Also, the rectifying plate is useful for bringing the lower opening into close contact with water face, when the outboard motor is mounted on the ship body and the ship is caused to alight on water.

A sixth aspect of the present invention is an outboard motor according to the first or second aspect, wherein the frame is mounted to be movable upward and downward relative to the ship body by a clamp with a female screw hole which is fixed to the ship body and a jack bolt engaged with the female screw hole in a threading manner and rotatably coupled to the frame.

According to the above configuration, a vertical position of the outboard motor can be adjusted according to an altitude of the ship body. That is, water flow at the bottom of the ship flows smoothly during travel so that the outboard motor can appropriately be set at a position where water can be drawn efficiently. Accordingly, occurrence of water flow resistance and occurrence of cavitation are prevented in a pump so that the ship can travel efficiently.

BEST MODE FOR CARRYING OUT THE INVENTION

Examples of embodiments of the present invention will be explained with reference to the drawings below. Incidentally, in the following explanation, the term "forward" means forward in a ship travelling direction, and the term "rearward" means rearward in the ship travelling direction.

First Embodiment

Figure 1:
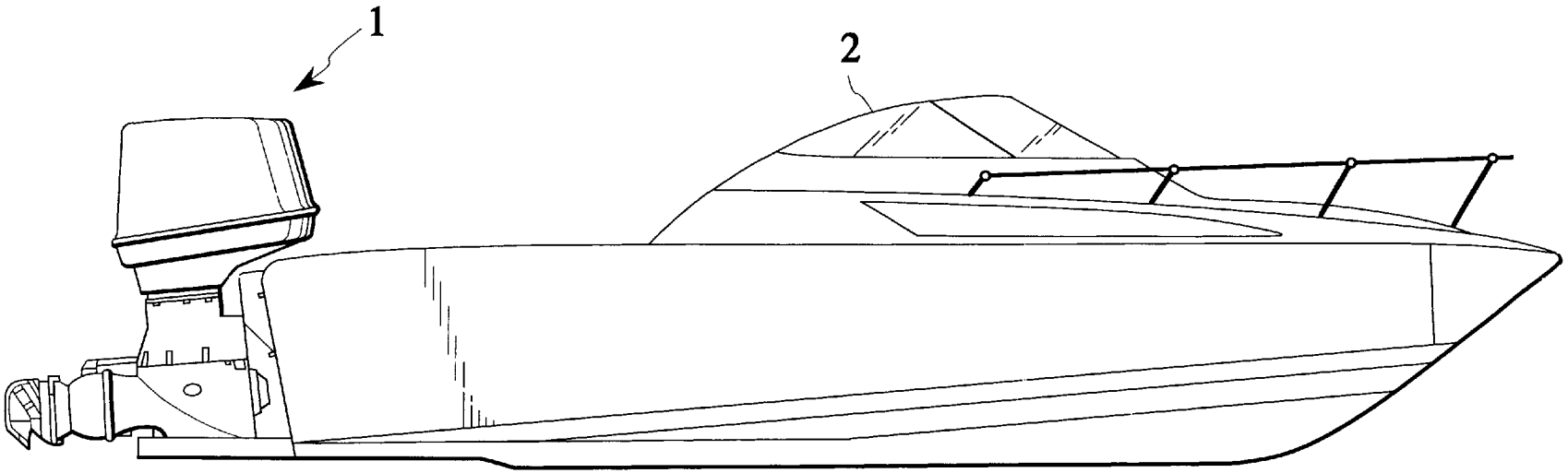
FIG. 1 is a schematic side view of a ship on which an outboard motor according to a fist embodiment of the prevent invention.

As shown in FIG. 1, a water jet propelling type outboard motor 1 is mounted on a stern of a ship 2.

Figure 2:
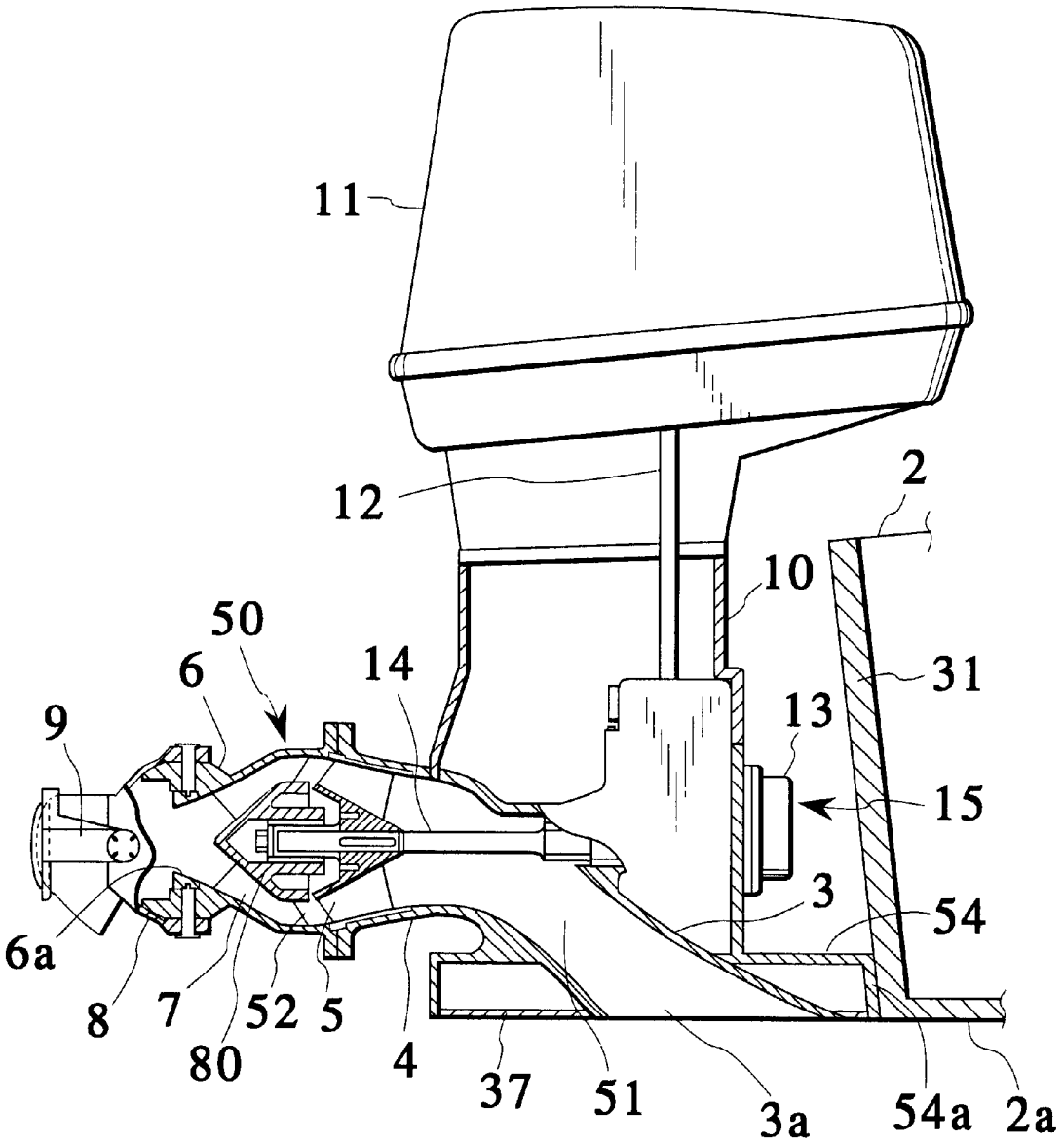
FIG. 2 is a side view showing the outboard motor in FIG. 1 with a partially vertical section.

As shown in FIG. 2, the outboard motor 1 comprises a casing member 50, a motor 11, a gear case 13, a vertical driving shaft (driving vertical shaft) 12, a horizontal following shaft (following transverse shaft) 14, a power transmission mechanism 15, and an impeller 5.

The casing member 50 includes a suction casing 3, a pump casing 4, and a discharge casing 6. A water suction inlet (lower opening) 3*a* is formed at one end of the suction casing 3 and the pump casing 4 is integrally provided at the other end thereof. A first inside space 51 extending obliquely upwardly and rearward from the suction inlet 3*a* is formed in the pump casing 4. One end of the discharge casing 6 is coupled to the pump casing 4 an the other end thereof is formed with a jetting outlet 6*a*. A second inside space 52 extending horizontally from the first inside space 51 to the jetting outlet 6*a* is formed inside both the casings 4, 6. The impeller 5 is provided inside the pump casing. 4.

Water below the suction casing 3 is drawn from the suction inlet 3*a* to pass through the first inside space 51 and it is pressurized b y the impeller 5 in the pump casing 4 to be jetted from the jetting outlet 6*a* of the discharge casing 6. The ship body 2 is propelled by jetting the pressurized water.

The guiding blade 7 for rectifying spiral flow which has been pressurized by the impeller 5 in a linear flow is provided within the second inside space 52 rearward of the impeller 5. A deflector 8 for switching a travel direction is formed outside of the jetting outlet 6*a* and a reverser 9 for backward propelling is formed outside of the deflector 8, respectively.

A box-shaped frame 10 extending upwardly is provided on an upper portion of the suction casing 3. The motor 11 is mounted on an upper end of the frame 10. A front and upper end of the frame 10 is fixed to the stern of the ship body by a fixing member which is not shown.

Figure 3:
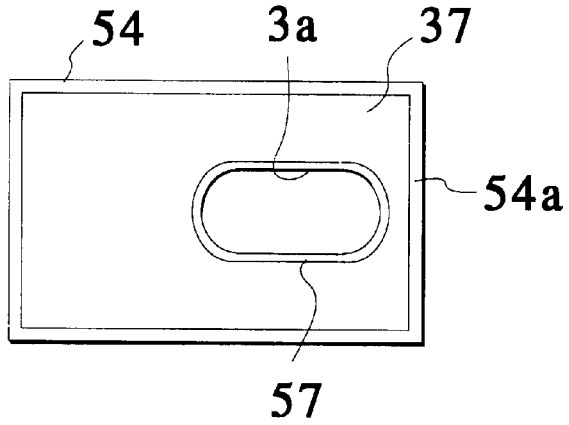
FIG. 3 is a bottom view of the outboard motor in FIG. 1.

A box-shaped pedestal portion 54 opening downward is provided at a lower portion of the suction casing 3. A peripheral wall of the pedestal portion 54 surrounds a peripheral edge of the suction inlet 3*a*. A front wall (front contacting wall) 54*a* of the pedestal portion 54 come sin close surface contact with a lower portion of a transom board 31 of the ship body 2 in a state where the frame 10 has been fixed to the ship body 2, and a lower end of the front wall 54*a* reaches almost the same position as that of a rearward bottom face 2*a* of the ship body 2. Also, as shown in FIG. 3, a rectifying plate 37 with a flange shape is fixed between the peripheral wall of the pedestal portion 54 and a peripheral edge of the suction inlet 3*a*. The suction inlet 3*a* is positioned to be generally flush with the rearward bottom face 2*a* of the ship body 2, and a front portion outer face of the rectifying plate 37 forms a continuous face between a lower end of the front wall 54*a* and a forward peripheral edge of the suction inlet 3*a*.

The gear case 13 is disposed laterally forward of the pump casing 4 and generally immediately above the suction inlet 3*a*. The gear case 13 is fixed to the suction casing 13. The vertical driving shaft 12 extends generally in a vertical downward direction to be inserted into the gear case 13. The horizontal following shaft 14 extends generally in a horizontal forward direction from inside of the pump casing 4 and projects from an inclining shoulder portion of the suction casing 3 to be inserted into the gear case 13. The impeller 5 is fixed coaxially to a rear end of the horizontal following shaft 14. Within the gear case 13, the vertical driving shaft 12 and the horizontal following shaft 14 are coupled to each other via the power transmission mechanism 15. Thereby, driving force of the motor 11 is input in the impeller 5 through the vertical driving shaft 12, the power transmission mechanism 15 and the horizontal following shaft 14.

Figure 4:
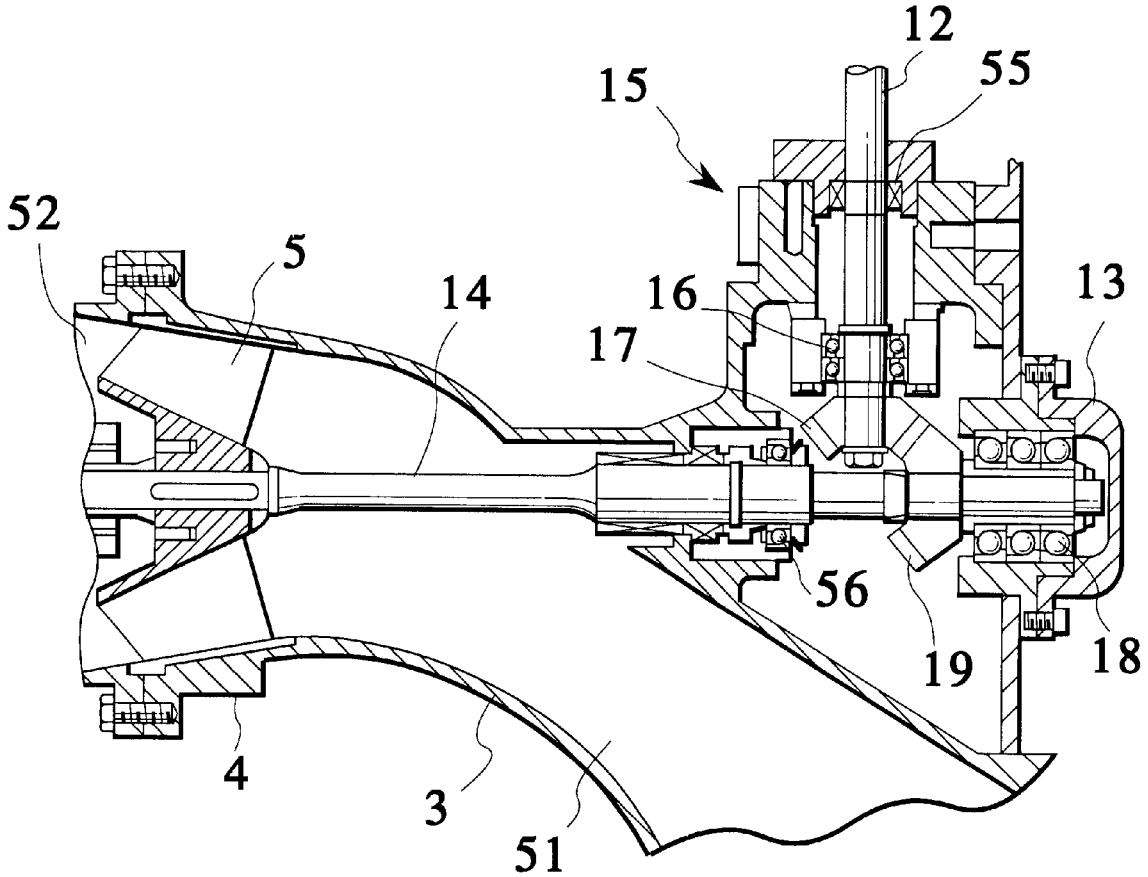
FIG. 4 is a side view showing a power transmission mechanism of the outboard motor in FIG. 1 with a vertical section.
Figure 5:
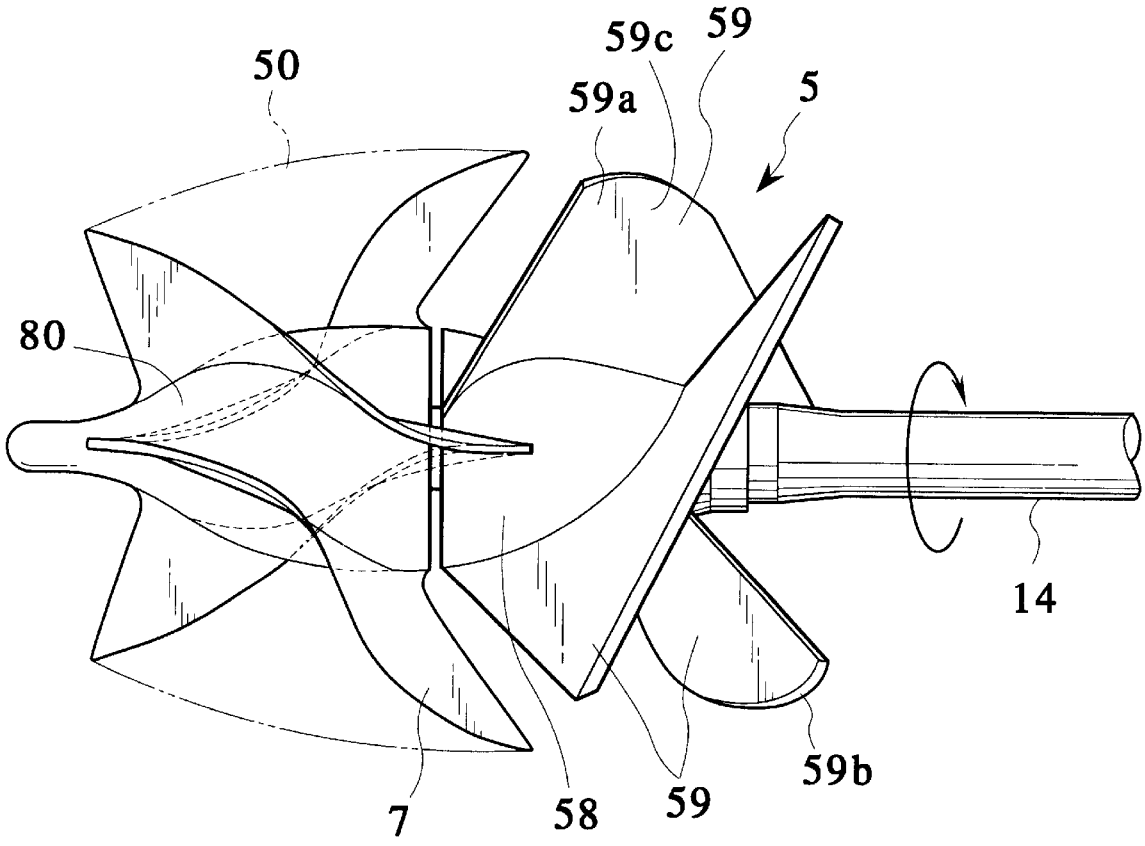
FIG. 5 is a perspective view of an impeller of the outboard motor in FIG. 1.

As shown in FIG. 4, the gear case 13 is fixed to an outer peripheral side wall of the suction casing 3 from which the horizontal following shaft 14 projects. The power transmission mechanism 15 is constituted with an upper bearing 16, an upper bevel gear 17, a transverse bearing 18, and a transverse bevel gear 19. The upper bearing 16 is fixed to an upper portion inside the gear case 13, and a lower portion of the vertical driving shaft 12 is rotatably supported by the upper bearing 16. The upper bevel gear 17 is fitted and fixed on a lower end of the vertical driving shaft 12. The transverse bearing 18 is fixed to a front portion of the gear case 13, and a front end of the horizontal following shaft 14 is rotatably supported by the transverse bearing 18. The transverse bevel gear 19 is fitted and fixed on a portion of the horizontal following shaft 14 in the vicinity of the front end thereof. The upper bevel gear 17 meshes with the transverse bevel gear 19. Incidentally, upper end transverse auxiliary bearings 55, 56 are respectively provided at an uppermost portion and a rear portion of the gear case 13. As shown in FIG. 5, the impeller 5 has a hub 58 coaxially fixed to a rear end of the horizontal following shaft 14 and a plurality of spiral blades 59 projecting from the hub 58. Proximal end portions of the blades 59 are phase-shifted to one another along a peripheral direction to be mounted on the hub 58. Outer peripheral edge portions 59*a* of the blades 59 are positioned in the vicinity of an inner peripheral face of the pump casing 4 in order to improve the volume efficiency and the balance efficiency of the impeller 5. Forward (water flowing-in side) outer peripheral distal end portions 59*b* of the blades 59 extend in a direction (forward) of the suction casing 3. Thereby, a wide suction inlet is formed.

According to the first embodiment, the vertical driving shaft 12 extending from the motor 11 and the horizontal following shaft 14 for rotating the impeller 5 are coupled to each other by the power transmission mechanism 15 in the gear case 13. The gear case 13 is disposed laterally forward of the second inside space 52 and generally immediately above the suction inlet 3*a*. Therefore, the horizontal following shaft 14 can be shortened and a projecting amount of the outboard motor 1 rearward of the ship body 2 can be reduced.

Accordingly, it is hard for the ship to be put in a sate where the center of gravity has bee shifted to the stern so that the bow has been raised. Thus, straight advancing performance during travel of the ship body 2 and travel stability during high speed sliding thereof are improved.

As the front end of the horizontal following shaft 14 is supported by the transverse bearing 18, a supporting strength of the horizontal following shaft 14 is increased so that wobbling of the horizontal following shaft 14 is minimized.

As the front wall 54*a* of the pedestal portion 54 has been brought into close contact with the lower portion of the transom board 31 of the ship body 2, water flow rising at the stern during travel does not flow in between the transom board 31 of the ship body 2 and the outboard motor 1. Accordingly, excess traveling resistance can be suppressed from occurring. Also, raising water is hard to strike on a peripheral portion of the outboard motor 1, and generation of the eddy generated due to this striking is prevented. Also, the suction inlet 3*a* is positioned on almost the same plane as the rearward bottom face 2*a* of the sip body 2, and a continuous face is formed between the lower end of the front wall 54*a* and the forward peripheral edge of the suction inlet 3*a* by the front portion outer face of the rectifying plate 37. Thereby, water flow at the ship bottom flows smoothly below the lower opening. Furthermore, water flow during travel is hard to strike on a lower portion side face of the outboard motor 1 and water flow below the suction inlet 3*a* is further rectified by the rectifying plate 37.

Accordingly, a turbulent flow is prevented from being generated below the ship bottom during travel, and straight advancing performance during travel is improved, so that steering the ship can easily be carried out. Also, as water flow at the ship bottom flows smoothly below the suction inlet 3*a*, the water suction efficiency to the suction inlet 3*a* is improved.

Also, the rectifying plate 37 is useful in bringing the suction inlet 3*a* into close contact with the water surface when the outboard motor 1 is mounted on the ship body 2 and the ship body 2 is caused to alight on water.

Further, as the spiral blades 59 has the outer peripheral distal end portions 59*b* extending towards the first inside space 51, a suction portion of the impeller 5 can be formed widely. Accordingly, floating material that flowed in from the suction inlet 3*a* does not readily stick to the impeller 5 and can easily be exhausted from the jetting outlet 6*a* together with pressurized water.

Second Embodiment

Next, a second embodiment will be explained with reference to FIGS. 6 and 7. Incidentally, similar portions to those in the first embodiment are attached with the same reference numerals therein, and explanation thereof will be omitted.

In an outboard motor 70 of this embodiment, a screen 21 for preventing floating material from flowing in the suction inlet 3*a* is provided. The screen 21 is movable from a position (closed position) wherein the suction inlet 3*a* has been closed to a position (open position) where it has been opened.

Also, in this embodiment, the pedestal portion 54 (refer to FIG. 2) is not provided, but a lower end of a peripheral wall (only a front wall 61 and a rear wall 62 are shown) of a frame 60 extends up to almost the same position as that of the suction inlet 3*a*. A lower portion (front contacting wall) 61*a* of a front wall 61 of the frame 60 is put in close contact with the transom board 31.

Figure 6:
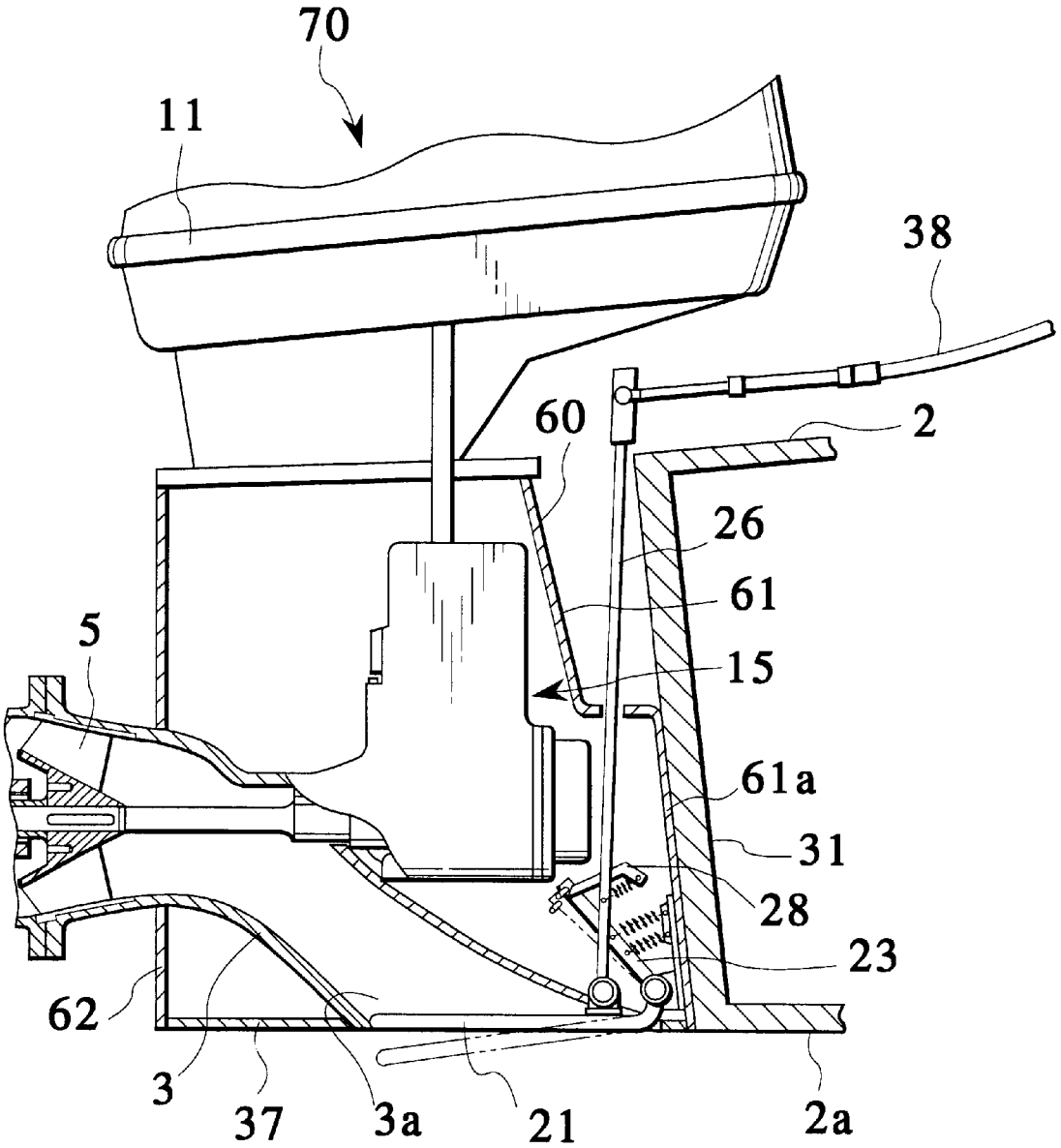
FIG. 6 is a side view showing an outboard motor according to a second embodiment of the present invention with a partially vertical section.
Figure 7:
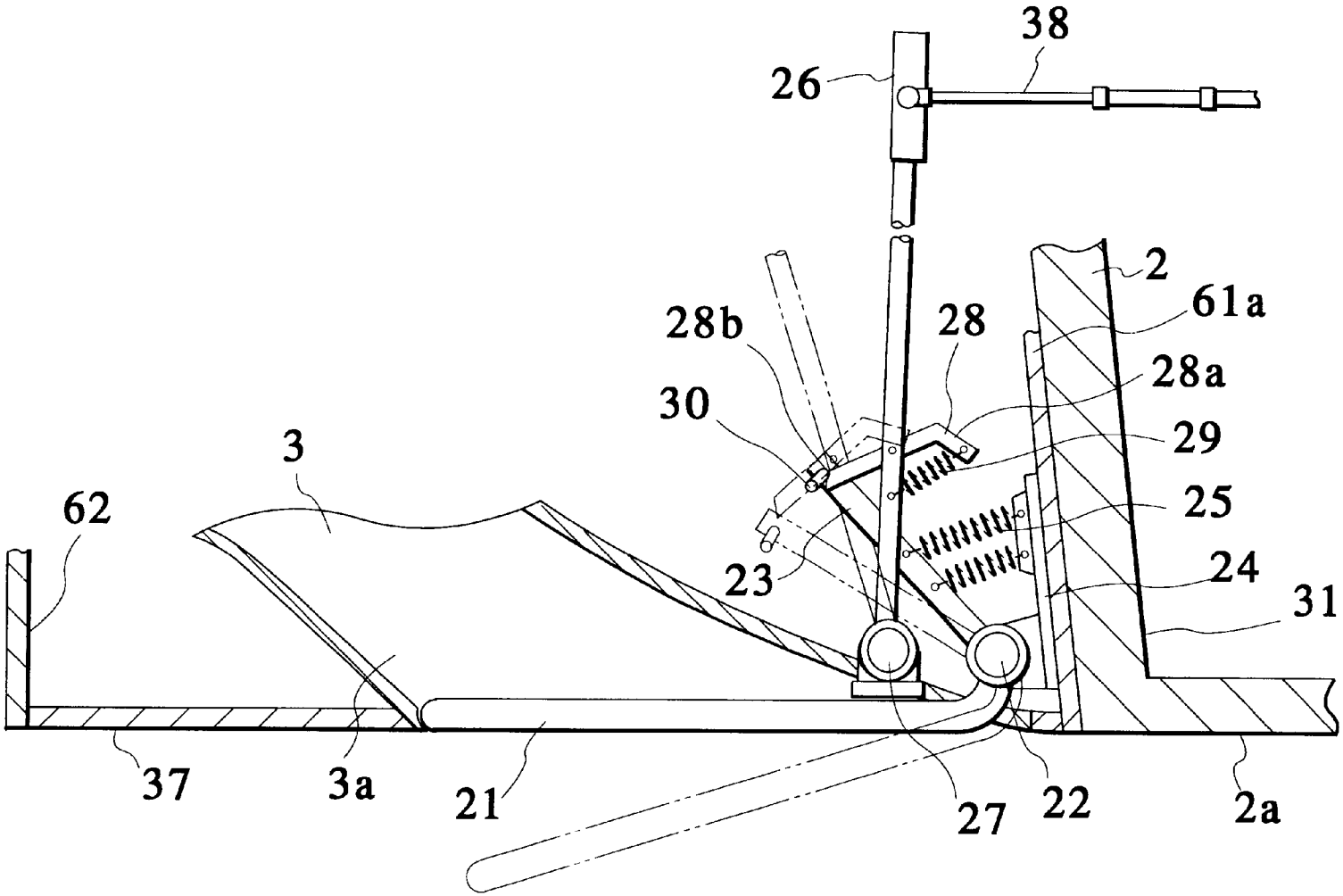
FIG. 7 is a partial sectional view showing a main portion in FIG. 6.

As shown in FIGS. 6 and 7, the screen 21 is provided at the suction inlet 3*a* of the suction casing 3. A supporting plate 24 is fixed to the lower portion 61*a* of the front wall 61, and a rotating shaft 22 is rotatably connected to the supporting plate 24. A front edge portion of the screen 21 and a proximal portion of the operating shaft 23 are fixed to an outer periphery of the rotating shaft 22, and when the operating shaft is swung in front and rear directions, the suction inlet 3*a* of the suction casing 3 is opened and closed. A spring (biasing member) 25 is provided between the operating shaft 23 and the supporting plate 35. The operating shaft 23 is always pulled towards a ship body side, so that the screen 21 is biased to the closed position covering the suction inlet 3*a*.

A rotating shaft 27 is rotatably supported a lower and outer side wall of the suction casing 3. A proximal portion of the operating shaft 26 is fixed to a periphery of the rotating shaft 27 and it is swingable in front and rear directions of the ship body 2. A central portion of an L-shaped hook 28 is rotatably supported to an intermediate portion of the operating shaft 26. An auxiliary spring 29 is provided between a front end portion 28*a* of the hook 28 and the operating shaft 26. The hook 28 is biased so as to be maintained at an almost constant intersecting angle to the operating shaft 26 by the spring 29. A push-pull cable 38 is coupled to an upper portion of the operating shaft 26 and the push-pull cable 38 extends up to a steering seat.

A protrusion 30 (first engaging portion) projecting in a direction intersecting a moving direction of the operating shaft 23 is provided at an upper end of the operating shaft 23. A moving region of a rear end face (second engaging portion) 28*b* according to swing of the operating shaft 26 and a moving region of the protrusion 30 according to swing of the operating shaft 23 overlaps each other sufficiently when the screen 21 has been put in the closed position, and they are gradually shifted to reduce their overlapping portion. When the screen 21 reaches an open position which has been opened sufficiently the protrusion 30 is completely released downward from the moving region of the rear end face 28 of the hook 28. Thereby, when the operating shaft 26 moves from a first position (shown with a solid line in FIG. 7) in an inclination manner rearward in a travel direction, the protrusion 30 is engaged with the rear end face 28*b* of the hook 28 to be pushed, the operating shaft 23 inclines and moves, and the screen 21 begins to move in an opening direction against the spring 25 resiliently. Furthermore, when rearward inclining movement of the operating shaft 26 proceeds, the operating shaft 26 moves beyond a second position (shown with a double dotted line in FIG. 7), and the protrusion 30 comes off completely from the moving region of the hook 28, an engaging state between the rear end face 28*b* of the hook 28 and the protrusion 30 is released. Instantaneously, the protrusion 30 enters in a lower side of the hook 28, the operating shaft 26 is instantaneously returned back to a stern side by the spring 25, and the screen 21 is returned to the closed position instantaneously. Thereafter, when the operating shaft 26 pulled back to the first position which is forward, a portion of the rear end face 28*b* side of the hook 28 rides beyond the protrusion 30, and the hook 28 returns back to an initial state by the resilient force of the spring 29. By swinging the operating shaft 23 is front and rear directions a plurality of times, the screen 21 intermittently opens/closes the suction inlet 3*a*. Regarding an opening/closing speed of the screen 21, an opening speed is slow, while a closing speed is rapid.

According to the second embodiment, when travelling in an area where there is floating material, the operating shaft 26 is moved appropriately in an inclining manner, rearward. Thereby, the screen 21 is closed after the suction inlet 3*a* is opened. At this time, the screen 21 behaves such that the screen 21 moves to the closed position rapidly, after the suction inlet 3*a* is opened slowly. Accordingly, while the screen 21 is being slowly moved in an opening manner, floating material, such as dirt of the like, which has stuck to the screen 21 is securely pushed to be flow out by water flow so that the screen 21 is cleaned. Also, as the screen 21 returns back to the closed position from the opened position, floating material is prevented from flowing into the suction inlet 3*a* during opening movement of the screen 21. Also, when the screen 21 rapidly returns from the closed position to the open position, an effect of brushing off the floating material stuck to the screen 21 is enhanced so that cleaning of the screen 21 is performed more excellently. Furthermore, by repeating the opening/closing operation a plurality of times, the cleaning effect for screen 21 is still further improved.

Also, as the push-pull cable 38 is coupled to the operating shaft 26 and the push-pull cable 38 extends to the steering seat of the ship body 2, the opening/closing operation of the screen 21 can easily be performed.

Third Embodiment

Next, a third embodiment will be explained with reference to FIG. 8. Incidentally, similar portions to those in the first and second embodiments are attached with the same reference numerals as those therein, and explanations thereof will be omitted.

An outboard motor 71 of this embodiment is mounted to the ship body 2 so as to be moved in upward and downward directions.

Figure 8:
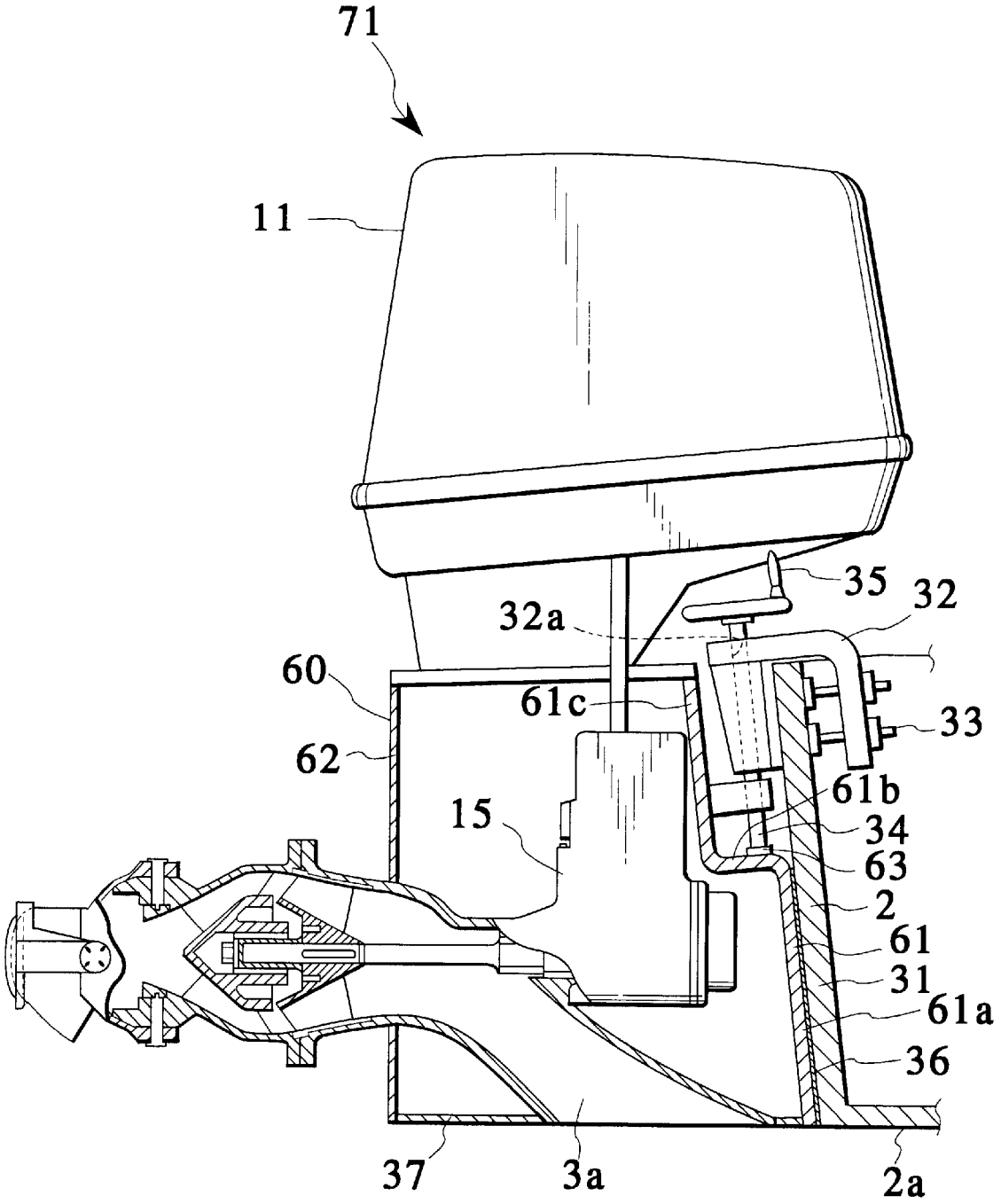
FIG. 8 is a side view showing an outboard motor according to a third embodiment of the present invention with a vertical section.

As shown in FIG. 8, the front wall of the frame 60 is provided with a lower portion 61*a*, an upper portion 61*c* positioned rearward from the lower portion 61*a*, and a generally horizontal stepped portion 61*b* formed in a bent manner between the lower portion 61*a* and the upper portion 61*c*. A close contacting plate 36 made of rubber is attached on an outer face of the lower portion 61*a* of the front wall 61. The close contacting plate 36 comes in close surface-contact with an outer face of the transom board 31 of the ship body 2.

A clamp 32 is fixed to an upper end portion of the transom board 31 by mounting screws 33. A female screw hole 32*a* is formed at a portion of the clamp 32 extending towards the stern, and a jack bolt 34 engaged with the female screw hole 32*a* in a threading manner extends downwardly. A lower end of the jack bolt 34 is coupled to a bearing 63 fixed on the stepped portion 61*b* of the front wall 61 of the frame 60. An upper end of the jack bolt 34 is fixed with a handle 35. The jack bolt 34 is moved upward and downward as a whole by rotating the handle 53 so that the outboard motor 71 suspended is moved upward and downward relative to the ship body 2.

According to the third embodiment, a vertical position of the outboard motor 71 can be adjusted according to the altitude of the ship body 2. That is, the outboard motor 71 can properly be set at a position where water flow at the ship bottom flows smoothly and water suction can be effected efficiently. Accordingly, occurrence of water flow resistance or occurrence of cavitation are prevented in the pump, so that the ship can travel efficiently.

Incidentally, in each of the above embodiments, the impeller 5 with the spiral blades 59 is used, but instead thereof a screw propeller can be used in this invention.

APPLICABILITY IN INDUSTRY

As described above, according to the present invention, a following transverse shaft can be shortened, and the amount of an outboard motor projecting rearward of a ship body can be reduced. As a result, it is hard for a ship to be put in a sate where the center of gravity has been shifted toward the stern of the ship and the bow has been raised, and straight advancing performance during travel and a travel stability during high speed sliding are improved. Accordingly, the present invention is useful for a water jet propelling type outboard motor.

What is claimed is:

1. A water jet propelling outboard motor system, comprising:

an outboard motor aft a stern of a vessel;

a support member fixed to the stern for supporting the outboard motor;

a duct member mounted to the support member, and formed with a downward inlet in a front part thereof, a rearward outlet in a rear part thereof, and a duct space between the inlet and the outlet;

an impeller disposed in the duct space, and configured to be driven by power from the outboard motor for drawing water from the inlet into the duct space and converting the drawn water into water jets to be discharged from the outlet;

a grid member swingable between an opened and a closed position relative to the inlet, the grid member having a first engaging part movable within a first range of movement, as the grid member is swung between the opened and closed positions;

a first link operative within a region restricted by the support member and the duct member;

a second link pivoted on the first link, the second link having a second engaging part movable within a second range of movement as the first link is operated within the restricted region together with the second link pivoting thereon, the second engaging part being engageable with the first engaging part pivoting thereon, the second engaging part being engageable with the first engaging part in a common region between the first and second ranges of movement; and biasing means for providing the grid member with a biased tendency to swing relative to the inlet and the second link with a biased tendency to pivot on the first link, whereby the common region is established to have an open interval containing a first position of the first engaging part wherein the grid member is in the closed position, and a second position of the first engaging part wherein the grid member is nearly at the open position, and a boundary containing a critical position of the first engaging part wherein the grid member is in the open position and wherein the grid member starts returning to the closed position.

2. A water jet propelling outboard motor system according to claim 1, wherein the impeller comprises a plurality of spiral blades having extended edges.

* * * * *

UNITED STATES PATENT AND TRADEMARK OFFICE

CERTIFICATE OF CORRECTION

PATENT NO. : 6,283,805 B1 
APPLICATION NO. : 09/463736
DATED : September 4, 2001
INVENTOR(S) : Eiichi Ishigaki It is certified that error appears in the above-identified patent and that said Letters Patent is hereby corrected as shown below:

Column 10, line 12, insert -- mountable --, after "outboard motor".
Column 10, line 13, insert -- adaptable to be --, after "support member".
Column 10, line 32, insert -- an operating shaft -- for "a first link".
Column 10, line 34, insert -- hook -- for "second link" before "pivoted on the".
Column 10, line 34, insert -- shaft -- for "first link" after "pivoted on the".
Column 10, line 34, insert -- hook -- for "second link" before "having a second engaging".
Column 10, line 36, insert -- shaft -- for "first link" after "movement as the".
Column 10, line 37, insert -- hook -- for "second link" after "together with the".
Column 10, line 39, delete "pivoting thereon, the second engaging part being engageable with the first engaging part".

Column 10, line 45, insert -- hook -- for "second link".
Column 10, lines 45-46, insert -- shaft -- for "first link".
Column 10, lines 46-47, insert -- be between -- for "have an open interval containing" after "is established to".

Column 10, line 49, insert -- at -- for "in".
Column 10, line 51, delete "nearly".
Column 10, line 51, insert -- a fully -- for "the" before "open position".
Column 10, line 52, insert -- said second position defines -- for "a boundary containing".
Column 10, lines 53-54, delete "wherein the grid member is in the open position and".
Column 10, line 58, insert -- outer distal end portions extending towards the inlet -- for "extended edges".

Signed and Sealed this

Fourth Day of March, 2008

JON W. DUDAS
*Director of the United States Patent and Trademark Office*